United States Patent [19]

Fürstenberg

[11] 3,998,039

[45] Dec. 21, 1976

[54] METHOD AND APPARATUS FOR OPEN-END SPINNING

[75] Inventor: Joachim Fürstenberg, Aichelberg, Germany

[73] Assignee: LTG Lufttechnische Gesellschaft mit beschrankter Haftung, Stuttgart, Germany

[22] Filed: Dec. 7, 1971

[21] Appl. No.: 205,679

[30] Foreign Application Priority Data

Dec. 9, 1970 Germany ..... 2060654

[52] U.S. Cl. ..... 57/58.95; 57/58.89; 57/101; 57/156

[51] Int. Cl.[2] ..... D01H 1/12

[58] Field of Search ..... 57/58.89, 58.95, 92, 57/101, 156

[56] References Cited

UNITED STATES PATENTS

| | | | |
|---|---|---|---|
| 3,411,283 | 11/1968 | Isomura | 57/58.89 |
| 3,521,440 | 7/1970 | Oskin et al. | 57/58.89 |
| 3,543,500 | 12/1970 | Bancroft et al. | 57/58.89 R |
| 3,557,542 | 1/1971 | Oskin et al. | 57/58.89 |
| 3,597,911 | 8/1971 | Schiltknecht | 57/58.89 X |
| 3,627,584 | 12/1971 | Stewart | 57/58.89 X |
| 3,930,356 | 1/1976 | Nagel | 57/58.95 |

*Primary Examiner*—Richard C. Queisser
*Assistant Examiner*—Charles Gorenstein
*Attorney, Agent, or Firm*—Edwin E. Greigg

[57] ABSTRACT

A method for open-end spinning according to which discrete fibers are fed into the interior of a rotor located in a spinning chamber and deposited in a fiber groove of the rotor. The fibers are thereafter drawn out of the spinning chamber as twisted fibers formed into a thread. The air which flows into the interior of the rotor is evacuated from the spinning chamber by suction.

The apparatus of the invention is arranged so that the spinning chamber has at least one air outlet opening through which air flowing into the interior of the rotor leaves the spinning chamber. The outlet is located in the cover portion of a housing and is connected to an air suction device by at least one air channel.

15 Claims, 2 Drawing Figures

METHOD AND APPARATUS FOR OPEN-END SPINNING

Figure 1:
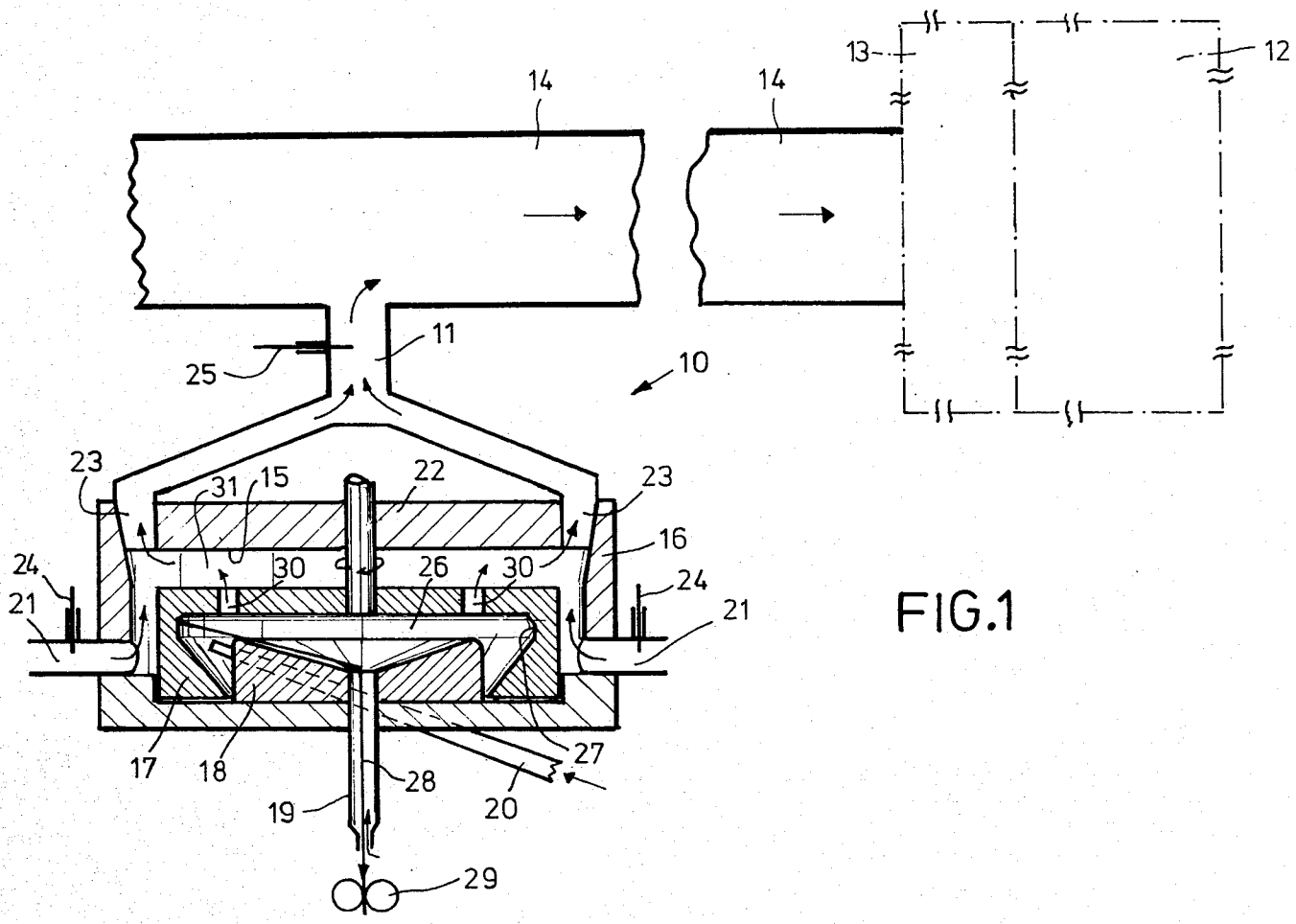

This invention relates to a method for open-end spinning in which fibers are inserted by means of an air current into the interior space of a driven rotor located in a spinning chamber and deposited in a fiber groove of the rotor, and in which they are drawn off as twisted fibers formed as a thread from the spinning chamber and an apparatus for the implementation of this method.

In known open-end spinning installations, with a rotor which is arranged in a spinning chamber and which is driven by an electric motor, discrete individual fibers are fed by means of an air current through a feeder channel into the interior of the rotor and they are deposited there, in the fiber groove of the rotor, by means of the centrifugal force acting upon them after they leave the feeder channel, and they are then continually drawn out of the fiber groove as twisted fibers formed as a thread through a thread evacuation channel. The rotor here rotates at very high speed, for example, 50,000 rpm. In the thread evacuation channel there is an air current flowing into the spinning chamber and this air current among others serves in order to exert a traction — during the initial spinning of the thread — upon the thread in the direction toward the interior of the rotor. It is customary to generate these two air currents by means of the rotor in that there are provided — in its front wall, which extends between its drive shaft and the fiber groove — cylindrical boreholes which are arranged in a manner inclined toward the rotation axis of the rotor, and these boreholes give the rotor the property of a blower wheel, so that an underpressure will develop through it during its rotation, in its interior and so that an overpressure will develop on its outside which faces away from the interior. The space area of the spinning chamber, in which an overpressure developes in this manner, is provided with one or more air outlets through which the air moved by the rotor leaves the spinning chamber. This design entails a series of disadvantages. The efficiency of the rotor, in its capacity as a blower wheel, is very low because it cannot be given an optimum design for a blower wheel in view of its spinning function. Because of its design as a blower wheel, the rotor requires a comparitively powerful electric motor. The blower output of the rotor is determined by its design and therefore cannot be adjusted. The blower output of the rotor furthermore depends on its speed so that, when we have different operational speeds, its blower output and thus also the velocity of the air current in the feeder channel will change. There is likewise no possibility of adjusting the blower output of the rotor to the fiber-technological conditions which change when differing fiber material is spun. The drive energy, which must be transmitted to the rotor in order to drive it, is converted into heat inside the spinning chamber so that comparatively high temperatures develop in the interior of the rotor and these high temperatures lead to the undesirable drying of the fibers. These high temperatures consequently are also due to the fact that the rotor is designed as a blower wheel and increase as the rotor speed increases.

To avoid these disadvantages, it is provided, in the method for open-end spinning according to the invention, that the entire air which flows into the interior of the rotor is evacuated from the spinning chamber by means of suction. According to the invention it is provided in a preferred manner that the air flowing into the interior of the rotor is evacuated, by means of a pressure drop generated through the off-suctioning, out of the interior of the rotor into the adjoining area or areas of the spinning chamber. We can proceed particularly advantageously in such a manner that the movement of air, through the interior of the rotor, is generated through the suction of air out of the spinning chamber.

This off-suctioning of air reduces the electric motor output which is required to drive the rotor and thus decreases the temperatures which develop in the interior of the spinning chamber in connection with the operational speed so that the fibers will no longer dry out as in the past.

The air movement, through the interior of the rotor, can be adjusted for optimum values, regardless of the particular operational speed of the rotor, for example, by means of choking or valve means which are adjustable and which go into action in the current path of the off-suctioned air and/or by altering the suction output of the air suction device which brings about the off-suctioning. When the air movement is equally great, the efficiency of the air suction device or devices, which bring about the off-suctioning, is considerably greater than the efficiency of a rotor designed as a blower wheel, so that the total required output needed to operate this apparatus for open-end spinning will be reduced and so that energy costs can thus be saved. Likewise, one can work with higher rotor speed than in the past.

When the rotor, as provided on a preferred basis according to the invention, does not have an air conveyance output of its own, the effect of the air circulation, which is generated by it and which is unavoidable in this kind of rotor design, can be eliminated by suctioning the air off, out of the spinning chamber, at one or more places, at which the air circulation generated by the rotating rotor does not support the off-suctioning.

In order further to reduce the electric motor power of the rotor, it is provided in a preferred modification of the invention that at least a part of the volume of the air flowing through the spinning chamber will be so conducted that it will exert a torque upon the rotor in combination with the latter's operational speed. For this purpose, the rotor may have scoops or fins on its outside, which faces away from its interior that has the fiber groove; the air, which flows to the air outlet or outlets of the spinning chamber, flows through and is deflected by the scoops in such a manner that a driving torque is exerted upon the rotor as a result. The rotor speed in this case however is furthermore determined by its electric-motor drive already in view of the required constancy of the speed; however, the output, which the electric motor drive must supply, will be reduced by the torque exercised by the air flowing through its scoops, so that the electric motor can be made correspondingly smaller and less powerful. The scoops at the same time act like cooling ribs so that the rotor is cooled better than if it did not have any scoops. Also, the speed constancy of the rotor is improved.

The apparatus for the implementation of the method according to the invention is characterized by the fact that the air outlet or outlets of the spinning chamber — through which the air suctioned into the interior of the rotor leaves the spinning chamber — are connected to an air suction device via at least one air duct. It is a good idea here to connect an air filter in front of the air suction device and this filter would separate the impurities and fibers carried along by the air current.

The air suction device may be of any customary known design, for example, a suction fan or a suction ventilator.

It is a good idea to provide air choking or valve means for the adjustable choking of the air flowing from the air outlet or outlets to at least one air suction device, in order to be able to adjust the velocity of the air through the spinning chamber, caused by the current, to differing values. It would be a good idea here to design the air choking means in such a way that they would also facilitate the complete blocking of the spinning chamber from the air suction device or devices or one could provide separate valve means for this purpose. The blocking of the air has the purpose of blocking the suctioning of air out of the spinning chamber when the rotor stands still, so that, for example, manipulations may be performed at the particular spining station, that is, manipulations in the course of which the suctioning of air would constitute a disturbance. The valve means are specially associated with each existing spinning chamber, in a central air suction device associated with several spinning stations, so that the air movement, generated by this suction device, can be adjusted for each spinning chamber regardless of the other spinning chambers and so that it can also be turned off independently of the other spinning chambers.

In known devices for open-end spinning of the abovementioned kind, the rotor has a front wall which is provided with air passage openings and which extends from its drive shaft to its fiber groove. The air, which introduces the fibers into the interior of the rotor, and the air suctioned in through the thread evacuation channel, here passes out of the interior of the rotor through the air passage openings in its front wall and then flows into the air outlet or outlets of the spinning chamber. As we said before, in known rotors of this kind, the air passage openings are arranged in a manner inclined toward the rotation axis of the rotor, so that they will give the rotor the property of a blower. In deviation from this customary design of the rotor, it is provided in one preferred version of the invention, that the longitudinal axes of the air passage openings, located in the front wall of the rotor, are parallel to the axis of the rotor. In this new design of the rotor, it is of course furthermore possible that the air, suctioned into the interior of the rotor, flows through the front wall of the rotor toward the air outlets, but this time the rotor is no longer designed as a blower, because the air passage openings, which are parallel with the rotation axis of the rotor, no longer have a blower effect.

In one preferred form of the invention it is provided that, in the wall of the spinning chamber, outside the wall area opposite the interior of the rotor, there is present at least one bypass air inlet opening. These bypass air inlet openings (or opening) serve to improve the cooling of the rotor through the conduction of additional air, whereby this additional air flows along its outside to the associated air outlet or outlets.

In one preferred version it is provided that the air flowing in through the bypass air inlet opening or openings, is suctioned off through the same air outlet or outlets through which the air flowing through the interior of the rotor is suctioned off. But it is also possible and it is advantageous in many cases to suction off this cooling air through one or more separate air outlets which are separated from the air outlet or outlets by seals through which the air coming out of the rotor interior is suctioned off.

It may be a good idea to connect adjustable air choking means in front of the bypass air inlet openings of the spinning chamber.

Figure 2:
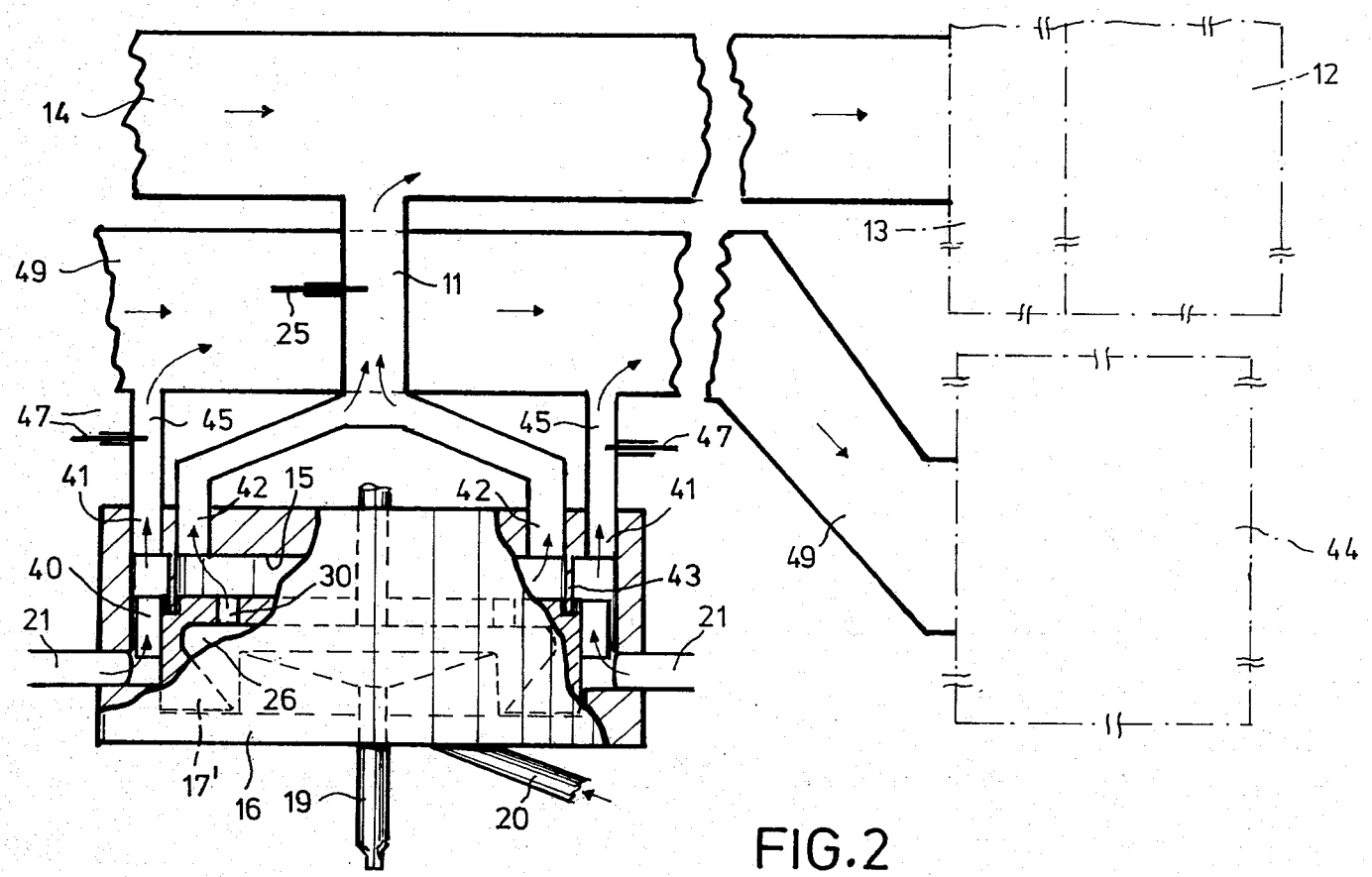

The examples of the invention are illustrated in the drawings in which:

FIG. 1 is a partly schematic illustration of a spinning station and a central air suctioning system of a spinning machine for open-end spinning, not illustrated in further detail, whereby the spinning station is illustrated in a longitudinal cross section; and FIG. 2 is a variation of FIG. 1, in a partial cross section illustration.

The spinning station 10 illustrated in FIG. 1 — as well as the other spinning stations of the particular machine which are not illustrated and which have the same design — are connected via channels 11 to a central air suction device 12 with air filter 13 connected in front. The air suction device 12 and the air filter 13 may be of any design customary in textile machine suction devices. The air suction device 12 can in practice be a single ventilator or blower, in front of which there is connected a main channel 14 that extends over the length of the machine and into which run the channels 11 coming from the individual spinning stations.

The individual open-end spinning devices 10 can be of the usual design, except for the novel air duct and air suctioning and the design changes in the rotor and the spinning chamber resulting from that.

The spinning device 10, which is shown in a longitudinal cross section, reveals a housing 16 with a spinning chamber 15, a rotor 17 rotatably positioned in housing 16, a funnel-shaped, stationary plate 18 with thread evacuation channel 19, a feeder channel 20 which serves for the supply of discrete individual fibers and which runs diagonally into the interior space of the rotor, two bypass air entry channels 21 which face each other diametrically in the circumferential wall of the spinning chamber and two air outlet openings 23 which are arranged diametrically with respect to each other in the cover 22 of the spinning chamber, said outlets leading from the interior of the spinning chamber 15 via branch channels into the channel 11.

Valve means, in the form of adjustable slides 24, 25, are associated with air entry channels 21 and with each channel 11.

The interior 26 of the rotor 17, powered by an electric motor not shown, in its upper circumferential area has a fiber groove 27, into which move the individual fibers which are introduced through the feeder channel 20 by means of a suction air current and which, in the known manner, are drawn off from there as threads 28 via the funnel-shaped area of plate 18 and the thread evacuation channel 19 by means of a driven roller pair 29, whereby this thread is given the twist required for its strength through the rotation of rotor 17.

The interior 26 of rotor 17 communicates, via a crown of cylindrical air passage openings 30 which are arranged at equal angular intervals and at equal radial intervals from its rotation axis and whose longitudinal axes are parallel to the rotation axis of the rotor 17, with the space-sector 31 of the spinning chamber 15 which borders on the outside of rotor 17. In order to make sure that no major air current can flow out of the interior 26 of rotor 17 around the lower edge of rotor 17 into this space-sector 31 — which, generally speaking, would be bad in terms of spinning technology — there is provided, between the lower sector of the rotor and the opposite housing wall, an interval which should be as small as possible and which here acts like a crack seal.

Because of the parallel arrangement of its air passage openings 30, rotor 17 does not have any noteworthy air conveyance effect, so that the entire air movement through the spinning chamber, is generated practically only by the air suctioning device 12 which is common to all spinning stations 10. Because of the resulting relatively small electric power output, which every rotor requires for its drive, the heat generation in each spinning chamber is reduced considerably as compared to the known installations of this kind, in which the rotor acts as a blower by virtue of the slanted position of its air passage openings and decisively produces the air movement through the spinning chamber.

In addition, in the apparatus illustrated, according to the invention, outside air is constantly suctioned out of the particular machine room into the space-sector 31 of the spinning chamber and the rotor 17 is thus additionally cooled by this air current. If required or desired, this cooling can be further improved by drawing this cooling air, not from the particular machine room, but rather by introducing cooled air into the air entry channels, that is, cooled air which has a temperature lower than the air temperature in the machine room.

Because of its high speed, the rotor has a tendency to compress air, swept along by its circumference, through the centrifugal force which here acts upon the air. But this effect is small compared to the suctioning brought about by the air suction device so that air will flow through bypass air inlet channels 21 into spinning chamber 15 with high speed and so that the entire air movement through the spinning chamber is generated practically only by the suctioning action. The air outlet openings 23 likewise are so arranged at an interval above the rotor that the air circulation generated by the rotor will not support the suctioning.

It is conceivable that it may be a good idea in some cases to blow air through the bypass air inlet channels 21 into the spinning chamber 15 under overpressure. For this purpose, for example, the bypass air inlet channels 21 could be connected to the pressure side of the air suction device 12. In this case, of course, the air blown in in terms of time must be so controlled that it will be considerably smaller than the air volume suctioned out in terms of time, so that air will continually be suctioned off out of the interior 26 of rotor 17 through its air passage openings 30 into the air outlets 23 of the spinning chamber.

Because of the action of the air suction device 12, air is continually suctioned into the interior 26 of the rotor 17 through feeder channel 20 and thread evacuation channel 19, whereby comparatively high air current speeds are required in order so to transport the discrete fibers in the feeder channel 20, which tapers conically in the downstream direction, that they will not be connected together but that they will rather leave the feeder channel 20 as individual fibers which do not touch each other. This is one important requirement in this open-end spinning method. This requirement is considerably easier to comply with by means of the apparatus according to the invention and it is much easier to adjust than in the known spinning devices, in which the rotor brings about the suctioning-in of the in-flowing air through the feeder channel. The suction output of the air suctioning device 12 must for this purpose be so big that — when slides 24, 25 are completely opened — it will generate such a strong air current in the feeder channel 20 that, even under the most unfavorable conditions, the fibers will not come out as interconnected fiber flakes, but rather "individually," out of the feeder channel into the interior 26 of rotor 17. By adjusting slide 25, one can then adjust the particular optimum flow speed in the feeder channel 20, whereby the particular position of this slide 25 is also dependent on the particular position of slides 24, as one can readily see.

As illustrated, the entry openings of the air entry channels 21 are arranged in a radial interval opposite the lower half of the circumference of rotor 17, so that the bypass air is forced to flow past the wall area of rotor 17 which has the fiber groove 27 and can thus cool this wall area particularly effectively. The air in the interior of rotor 17 is hotter than the air flowing in through the air entry channels 21. As illustrated, it is therefore practically so evacuated from the rotor 17 that it will not sweep over the circumferential wall of the rotor and so that it will not interfere with the cooling of the rotor in this area.

The surfaces of rotor 17 are designed axially symmetrically and smooth so that the rotor encounters the smallest possible air resistance.

The apparatus 10 can be operated also when slides 24 are closed, if one can without disadvantage with cooling through bypass air under certain operational conditions. If no cooling of the bypass air is required in all occurring operational conditions, then the bypass air inlet openings 21 can also be omitted, so that the housing at these two points will be constantly closed. This offers the advantage of a smaller expenditure in terms of construction and it also reduces the energy requirement for off-suctioning. Since the heat generation in the spinning chamber 15 however goes up as the speed of rotor 17 goes up, the bypass air, flowing in through openings 21, offers the possibility of working with higher operational speed than without bypass air.

The reduction of the temperatures occurring in the interior of the rotor during operation and achieved through the installation according to the invention effectively counteracts the drying of the fibers, which improves the properties of the spun thread, especially its strength. Likewise, one can work with higher rotor speed than in the known apparatus of this kind.

FIG. 2 shows a variation of portions of FIG. 1, where parts agreeing with FIG. 1 have been provided with the same reference symbols. This version according to FIG. 2 differs from the version according to FIG. 1 essentially by virtue of the fact that the air, flowing in through the bypass air inlet openings 21 into the spinning chamber 15, flows through scoops or fins 40 which are attached to the circumference of rotor 17′ and then flows out of the spinning chamber through two separate air outlets 41. These air outlets 41 are separated from the two air outlets 42, through which the air, flowing from the interior 26 of rotor 17′ is suctioned off through the air passage openings 30 of the rotor by means of air suction device 12, through a circular-ring-shaped separating wall 43, which is arranged firmly on the housing 16 and which engages a ring-shaped groove in the rotor for sealing purposes, so that completely separate flow paths are created for the air flowing through the interior of rotor 17′ and for the bypass air flowing from the openings 21 toward the outlets 41. The bypass air here, as illustrated, is suctioned through its associated external ring sector of the spinning chamber by means of a separate air suction device 44 via channels 45, each provided with a slide valve 47 and a main channel 49. The additional spinning stations, not shown here, are connected correspondingly to the main channel 49 via the outer channels. This second air suction device 44 can advantageously have a greater output than the air suction device 12 which is connected with the air outlets 42, so that the bypass air volume, in terms of time, can be adjusted to higher values than the air volume flowing through the interior of rotor 17′ in terms of time.

The scoops 40 of rotor 17′ are designed in the known manner in such a fashion that they will exercise a driving torque upon the rotor by virtue of the deflection of the bypass air flowing through them; the direction of rotation of the torque is the same as the direction of rotation of the electric motor drive and the output to be supplied to the electric motor drive is thus reduced. This, among others, improves the speed constancy of the rotor because the latter is usually driven by an electric motor — which is common to all spinning stations of the particular machine — via a friction gear, so that the reduced electric motor output of the rotor brings about less slippage and thus better speed constancy of the rotor.

Rotor 17′, with the exception of its scoops 40, corresponds to rotor 17 in FIG. 1; in particular, the air passage openings are likewise parallel to its rotation axis.

In the version according to FIG. 2, the bypass air flow path 21, 41, 45, shown in the version according to FIG. 2, is completely separated from the current path 19, 20, 26, 42, 11 leading through the interior of rotor 17′; because of this, this particular bypass current path can be charged with compressed air, instead of with suction air, in another preferred version. When the scoops 40 are changed correspondingly, the current flow direction of the bypass current path can also be reversed. In FIG. 2, the scoops can in many cases also be omitted so that the bypass air will then exclusively serve to cool the rotor 17′.

In the version according to FIG. 1, if desired, the rotor can be provided with the same scoops 40 as in the version according to FIG. 2.

What is claimed is:

1. In a method for open-end spinning in which discrete fibers are fed into the interior of a power driven rotor located in a spinning chamber and deposited in a fiber groove of the rotor, and in which they are twisted and drawn out of the spinning chamber as a thread, the improvement wherein a portion of the volume of air flowing through the spinning chamber exerts a driving torque on the rotor, and wherein all of the air, which flows into the interior of the rotor, is evacuated from the spinning chamber by suction.

2. The method as defined in claim 1, wherein the portion of the volume of air which exerts a driving torque on the rotor is evacuated from the spinning chamber by a suction other than the suction which evacuates all of the air which flows into the interior of the rotor from the spinning chamber.

3. The method as defined in claim 1, wherein the portion of the volume of air which exerts a driving torque on the rotor is blown through the spinning chamber and is retained separated from the air which flows into the interior of the rotor and is evacuated from the spinning chamber by suction.

4. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted fibers as a thread from the fiber groove out of the spinning chamber; and at least one air passage in the rotor connecting the interior of the rotor with an adjoining area of the spinning chamber; the chamber having at least one air outlet opening, the improvement wherein the at least one air outlet opening, through which air flowing into the interior of the rotor leaves the spinning chamber, is connected to an air suction device by at least one air channel, wherein the wall of the spinning chamber defined by the housing is provided with at least one bypass inlet opening, and wherein the rotor is provided on the outside of one of its walls with scoops in the path of the air flowing from the at least one bypass inlet opening, whereby said air exerts a torque on the rotor in the direction of its rotation.

5. Apparatus according to claim 4, wherein the chamber has a plurality of air outlet openings, wherein the wall of the spinning chamber defined by the housing is provided with a plurality of bypass inlet openings, and wherein each of said plurality of air outlet openings is associated with at least one of said plurality of bypass inlet openings.

6. Apparatus according to claim 4, wherein two suction devices and associated air channels are provided and two air outlet openings, with each of the air outlet openings being associated with said at least one bypass inlet opening and being connected to a respective one of the suction devices through its associated air channel.

7. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted fibers as a thread from the fiber groove out of the spinning chamber; and at least one air passage in the rotor connecting the interior of the rotor with an adjoining area of the spinning chamber; the chamber having at least one air outlet opening, the improvement where the at least one air outlet opening, through which air flowing into the interior of the rotor leaves the spinning chamber, is connected to an air suction device by at least one air channel, wherein the wall of the spinning chamber defined by the housing is provided with at least two bypass inlet openings, and wherein an adjustable valve is provided in one of the bypass inlet openings.

8. Apparatus according to claim 7, wherein an adjustable valve is provided in each bypass inlet opening.

9. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted fiber as a thread from the fiber groove out of the spinning chamber; and at least one air passage in the rotor connecting the interior of the rotor with an adjoining area of the spinning chamber; the chamber having at least one air outlet opening, the improvement wherein the at least one air outlet opening, through which air flowing into the interior of the rotor leaves the spinning chamber, is connected to an air suction device by at least one air channel, wherein the wall of the spinning chamber defined by the housing is provided with at least one bypass inlet opening, and wherein the at least one bypass inlet opening, and the associated at least one air outlet opening are positioned opposite one another on either side of at least a portion of an exterior wall of the rotor, whereby the entire bypass air will flow along the circumferential wall of the rotor.

10. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted fiber as a thread from the fiber groove out of the spinning chamber; and at least one air passage in the rotor connecting the interior of the rotor with an adjoining area of the spinning chamber; the improvement wherein the wall of the spinning chamber defined by the housing is provided with at least one bypass inlet opening, and wherein the chamber has a plurality of air outlet openings through which air flowing into the interior of the rotor leaves the spinning chamber and through which air from said at least one bypass inlet opening leaves the spinning chamber, with at least one of said plurality of air outlet openings, through which air flowing into the interior of the rotor leaves the spinning chamber, being connected to an air suction device by at least one air channel, and with at least one of said plurality of air outlet openings, through which air flowing into the spinning chamber from said at least one bypass inlet opening leaves the spinning, chamber being connected to another air suction device by another at least one air channel.

11. Apparatus according to claim 10, wherein the rotor is provided on the outside of one of its walls with scoops in the path of the air flowing from the at least one bypass inlet opening, whereby said air exerts a torque on the rotor in the direction of its rotation.

12. Apparatus according to claim 10, wherein the wall of the spinning chamber defined by the housing is provided with a plurality of bypass inlet openings, and wherein each of said plurality of air outlet openings is associated with at least one of said plurality of bypass inlet openings.

13. In an apparatus for open-end spinning, comprising: a housing; a spinning chamber defined within the housing; a power driven rotor within the chamber; a feeder channel for feeding discrete fibers to the interior of the rotor by means of a current of air; a fiber receiving groove in the interior of the rotor; a thread evacuation channel for conducting twisted fiber as a thread from the fiber groove out of the spinning chamber; and at least one air passage in the rotor connecting the interior of the rotor with an adjoining area of the spinning chamber; the improvement wherein the wall of the spinning chamber defined by the housing is provided with at least one bypass inlet opening, and wherein the chamber has a plurality of air outlet openings through which air flowing into the interior of the rotor leaves the spinning chamber and through which air blown into the spinning chamber through said at least one bypass inlet opening leaves the spinning chamber, with at least one of said plurality of air outlet openings, through which air flowing into the interior of the rotor leaves the spinning chamber, being connected to an air suction device by at least one air channel, and with at least one of said plurality of air outlet openings being connected to another at least one air channel into which air blown into the spinning chamber through said at least one bypass inlet opening flows under the influence of the blowing pressure.

14. Apparatus according to claim 13, wherein the rotor is provided on the outside of one of its walls with scoops in the path of the air flowing from the at least one bypass inlet opening, whereby said air exerts a torque on the rotor in the direction of its rotation.

15. Apparatus according to claim 13, wherein the wall of the spinning chamber defined by the housing is provided with a plurality of bypass inlet openings, and wherein each of said plurality of air outlet openings is associated with at least one of said plurality of bypass inlet openings.

* * * * *